US005569002A

United States Patent [19]

Kleine

[11] Patent Number: 5,569,002

[45] Date of Patent: Oct. 29, 1996

[54] HOLLOW ANNULAR DRILL BIT WITH HOLLOW CYLINDRICAL CARRIER MEMBER

[75] Inventor: Werner Kleine, Achim, Germany

[73] Assignee: Hilti Aktiengesellschaft, Schaan, Liechtenstein

[21] Appl. No.: 542,087

[22] Filed: Oct. 12, 1995

[30] Foreign Application Priority Data

Oct. 15, 1994 [DE] Germany ..... 44 36 915.8

[51] Int. Cl.[6] ..... B23B 51/04

[52] U.S. Cl. ..... 408/204; 408/703; 175/403

[58] Field of Search ..... 408/703, 204–209; 175/403

[56] References Cited

U.S. PATENT DOCUMENTS 1,115,010 10/1914 Patrosio ..... 408/204
3,308,689 5/1967 McDonald .
4,274,769 6/1981 Multakh ..... 408/204
4,408,935 10/1983 Miyanaga ..... 408/206

FOREIGN PATENT DOCUMENTS 0340340 11/1989 European Pat. Off. .
3407427 8/1985 Germany .
3408093 9/1985 Germany .

*Primary Examiner*—Steven C. Bishop
*Attorney, Agent, or Firm*—Anderson, Kill & Olick P.C.

[57] ABSTRACT

A hollow annular drill bit is formed of an axially extending hollow cylindrical carrier member (1) and cutter members (2). The cutter members (2) are secured in recesses (1*c*) in the carrier member, so that they project axially from and radially inwardly and radially outwardly from the leading end region of the carrier member. The carrier member (1) has increased wall thickness sections enclosing the recesses, whereby sufficiently large connecting surfaces are available for securing the cutter members (2).

4 Claims, 1 Drawing Sheet

HOLLOW ANNULAR DRILL BIT WITH HOLLOW CYLINDRICAL CARRIER MEMBER

BACKGROUND OF THE INVENTION

The present invention is directed to a hollow annular drill bit with a hollow cylindrical carrier member with open recesses in its leading end in which cutter members are secured and project axially from the leading end of the carrier member and also outwardly from its inside and outside surfaces.

Hollow annular drill bits are used for forming large diameter boreholes in components, where the boreholes are used mainly for the passage of pipelines or the like. Masonry, concrete, rock or the like can be the materials forming the components.

The structure of hollow annular drill bits is well known and comprises, as a rule, a hollow cylindrical carrier member having a leading end with open recesses. Cutter members are secured in these open recesses and serve for the removal of material from the components being drilled. The cutter members can be formed of hard metal, polycrystalline diamond platelets, diamond cutting edges formed of diamond grains embedded in a matrix material, and the like. The connection between the cutter members and the carrier member can be effected by soldering, welding or sintering.

To assure that the material drilled from the components is carried away and that the friction of the carrier member within the borehole being formed does not become excessive, it has been known to form the annular drill bits so that an annular gap is produced between the carrier member and the borehole in the component. In such hollow annular drill bits it has been known to select the dimension of cutter members measured in the radial direction to be somewhat greater than the wall thickness of the carrier member, so that the cutter members project beyond the inner and outer surfaces of the carrier member. Such a hollow annular drill bit is disclosed in DE-OS 39 30 250.

Due to the difference between the wall thickness of the carrier member and the radial dimension of the cutter members, only a relatively small connection surface is available in such hollow annular drill bits for a soldered connection. Since hollow annular drill bits are subjected to considerable loads due to the torque applied and possibly also because of the forces acting on them, the cutter members can become detached and the hollow annular drill bit becomes useless.

In the hollow annular drill bit known in CH-PS 414 438 the entire leading end region of the carrier member is provided in the circumferential direction with a larger wall thickness which corresponds to the radial dimension of the cutter members As a result, there is no difference between the wall thickness of the carrier member and the radial dimension of the cutter members, so that the entire dimension of the cutter members in the radial direction is available for connection with the carrier member. The disadvantage of detachment of the cutter members is largely prevented, however, only with the substitution of a very essential disadvantage, namely that an increase in the friction of the carrier member within the borehole being produced is due to the larger wall thickness at the leading end region of the carrier member. Further, the drilled material cannot escape because there is no annular gap in this leading end region. Apart from the heat caused by friction, there is also a compaction of the drill material so that overloads are developed resulting in a drop in output which can lead to premature failure of the hollow annular drill bit.

SUMMARY OF THE INVENTION

Therefore, the primary object of the present invention is to provide a hollow annular drill bit which operates at a high efficiency and, in addition, has a long useful life.

In accordance with the present invention, the carrier member of the hollow annular drill bit has increased thickness regions extending around and bordering the recesses.

With the increased thickness of the carrier member extending around the recesses there is an enlargement of the connection surfaces so that cutter members are adequately secured even when subjected to great loads. The conventional measures for securing the cutter members, such as soldering, welding, or centering are available for securing the cutter members. Apart from the increased thickness of the connection surfaces, the friction between the carrier member and borehole to be formed in the component is not substantially increased by the partial increased thickness sections, particularly not in a manner that results in excessive heat generation.

Since the increased thickness sections do not extend around the entire circumference of the leading end of the carrier member, sufficient space is available for removing the drilled material. This also eliminates the danger of the drilled material becoming compacted which can result in a drop in output of the drill bit.

It is possible that the increased thickness can be provided only on the outer surface of the carrier member, since the greater friction is developed at the outer surface and also the removed drilled material must be carried away for the most part along the outer surface. It is also possible that the increased thickness is provided only at the inner surface of the carrier member. Such an embodiment is suited for hollow annular drill bits used mainly for drilling short boreholes. An optimum arrangement, however, has the wall thickness increased at both the inner and outer surfaces of the carrier member.

The wall thickness of the carrier member around the recesses is mainly in the range of 1.2 to 1.8 times the remaining wall thickness of the carrier member independently of whether the projecting portion is at the inner surface, the outer surface or at both surfaces.

The increased thickness sections can be adapted in the circumferential direction to the particular application and the permissible diameter relationships involved. The dimension of the increased thickness sections on both sides of the recesses measured in the circumferential direction of the carrier member is preferably to the range of the 0.3 to 1 times the dimension of the recesses measured in the circumferential direction of the carrier member. The increased thickness sections in the circumferential direction are appropriately symmetrical relative to the recesses.

The dimension of the increased thickness sections measured in the axial direction is also advantageously matched to the particular application. Preferably, the increased thickness sections extend adjacent to the base of the recesses opposite to the drilling direction by a dimension corresponding to 0.5 to 1.4 times the width of the recesses measured in the circumferential direction of the carrier member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
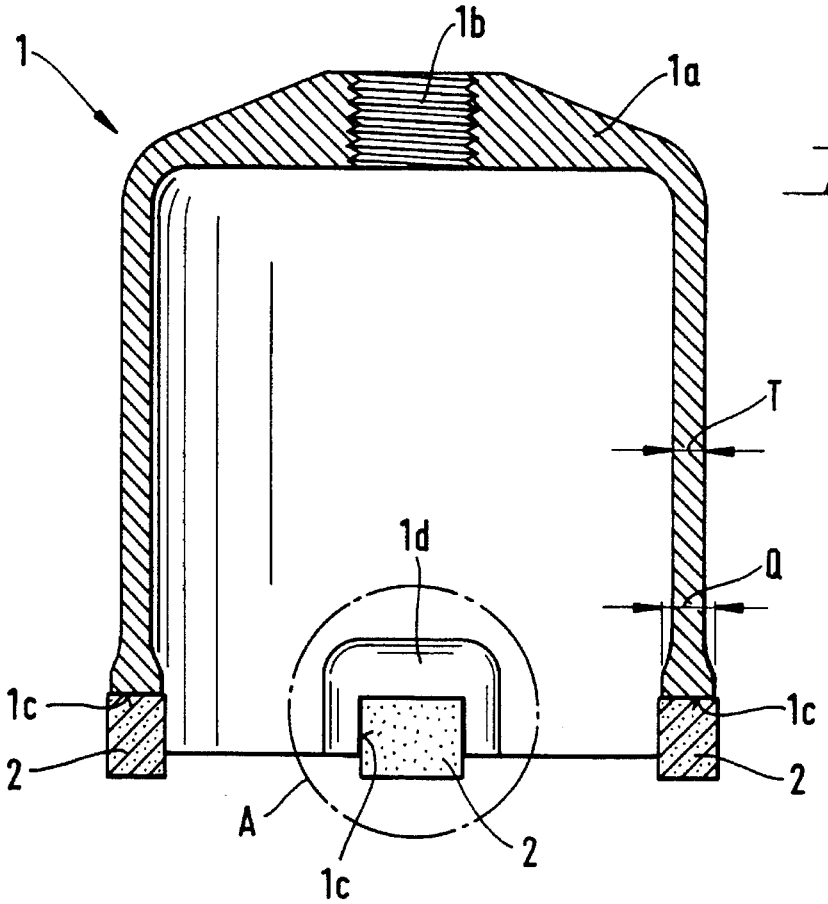
FIG. 1 is an axially extending sectional view of a hollow annular drill bit embodying the present invention.

In FIG. 1 a hollow annular drill bit is shown formed of a carrier 1 and cutter members 2. The carrier number 1 has a leading end containing the cutter members 2 and a trailing end formed as a base 1*a* with a centrally located threaded bore 1*b* extending through the base so that an adapter can be inserted into the carrier member.

Figure 2:
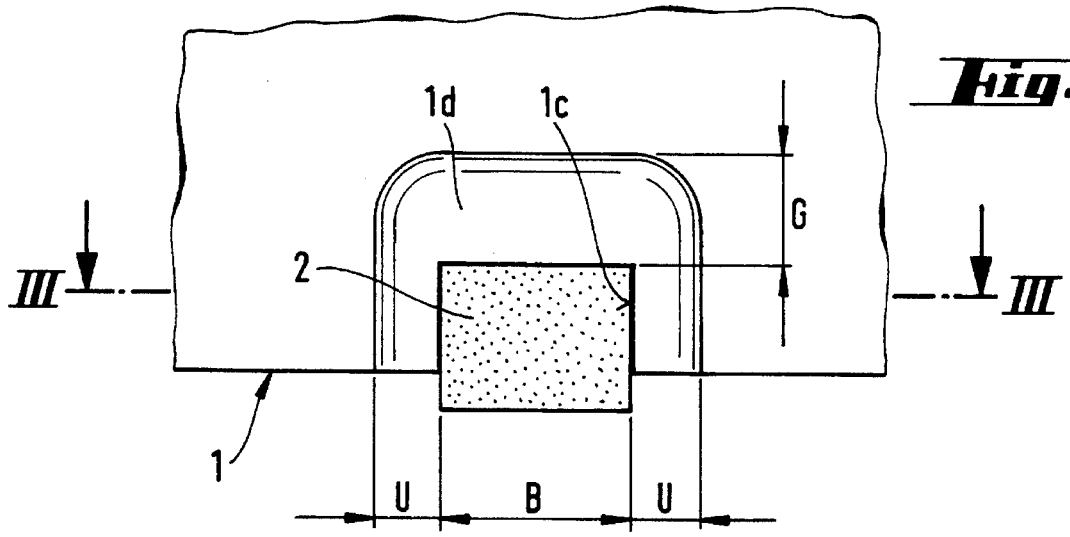
FIG. 2 is an enlarged view of the detail A shown in FIG. 1.
Figure 3:
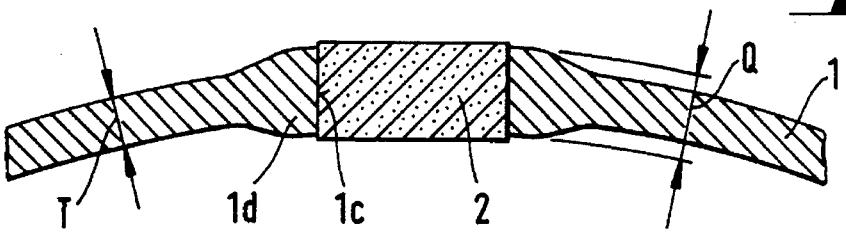
FIG. 3 is a cross sectional view taken along the line III—III in FIG. 2.

As illustrated in FIG. 1 as well as in FIGS. 2 and 3, the cutter members 2 are each disposed in a recess 1*c* in the leading end of the carrier member with the cutter members spaced angularly apart. The carrier member 1 has increased thickness sections 1*d* extending along the axially extending sides of the recesses 1*c* as well as the circumferentially extending base side of the recesses. As displayed in FIG. 1 and in particular FIG. 3, the increased thickness sections 1*d* project outwardly from the wall thickness T of the carrier member, that is, at both the inside and outside surfaces of the carrier member. Therefore, wall thickness Q of the increased thickness sections 1*d* is greater than the remaining wall thickness T of the carrier member, however, the wall thickness Q is essentially smaller or equal to the radially measured thickness of the cutter members 2.

It can be seen in FIG. 1 and, in particular, in FIG. 2, that the increased thickness sections 1*d* extend in the circumferential direction of the carrier member on both sides of the recesses for the dimension U measured in the circumferential direction of the carrier 1. The dimension of the increased thickness sections including the recesses is a combination of the dimensions U plus the circumferential dimension B. Moreover, the increased thickness sections 1*d* extend in the axial direction from the leading end of the carrier member to the base side, and then from the base side of the recess by the dimension G as shown in FIG. 1, and especially in FIG. 2.

Carrier number 1 can be manufactured in many ways. Preferably, by reshaping of the carrier member without any machining. Furthermore, there are various possibilities of securing the carrier the cutter members to the carrier member. A preferred arrangement is to form a soldered connection.

While specific embodiments of the invention have been shown and described in detail to illustrate the application of the inventive principles, it will be understood that the invention may be embodied otherwise without departing from such principles.

What is claimed as new and desired to be protected by Letters Patent is set forth in the appended claims:

1. A hollow annular drill bit comprises an axially extending hollow cylindrical carrier member (1) having an axially extending inner surface and an axially extending outer surface, a leading end and a trailing end each extending transversely of the axial direction thereof and a radial thickness (T), the leading end of said carrier member having recesses (1*c*) open in the leading end and extending towards the trailing end, cutter members (2) being secured in said recesses and extending axially outwardly from the leading end of the said carrier member and radially outwardly from the outer and inner surfaces of said carrier member, said recesses having circumferentially spaced axially extending sides and a circumferentially extending base side spaced axially from the leading end, said carrier member having increased thickness wall sections (1*d*) extending along said axially extending sides and base side for the full axial extent thereof and circumferentially outwardly from said axially extending sides and axially from said base sides toward said trailing end, increased thickness wall sections (1*d*) project radially outwardly from the outer surface of said carrier member (1) and radially inwardly from the inner surface of said inner member (1).

2. A hollow annular drill bit, as set forth in claim 1, wherein the radial dimension of the increased wall thickness sections (1*d*) are in the range of 1.2 to 1.8 times the radial thickness (T) between the inner surface and outer surface of said carrier member (1).

3. A hollow annular drill bit, as set forth in claim 1, wherein said increased wall thickness sections (1*d*) extend in the circumferential direction by a dimension (U) on both axially extending sides of said recesses (1*c*) and are in the range of 0.3 to 1 times a dimension (B) of said recesses measured in the circumferential direction of the said carrier member (1).

4. A hollow annual drill bit, as set forth in claim 1, wherein said increased thickness wall sections (1*d*) have a dimension extending axially from the base side of said recesses in the range of 0.5 to 1.4 times the circumferential dimension (B) of the recesses (1*c*) measured in the circumferential direction of said carrier member (1).

* * * * *